United States Patent [19]

Markiewicz

[11] Patent Number: 4,989,417

[45] Date of Patent: Feb. 5, 1991

[54] COLD STORAGE WAREHOUSE

[76] Inventor: Stanley Markiewicz, 842 Shoreview Dr., Henderson, Nev. 89015

[21] Appl. No.: 433,688

[22] Filed: Nov. 8, 1989

[51] Int. Cl.[5] ..... F25D 11/02

[52] U.S. Cl. ..... 62/441; 62/407; 62/DIG. 16

[58] Field of Search ..... 62/407, 325, DIG. 16, 62/440, 89, 97, 417, 441; 98/31.6

[56] References Cited

U.S. PATENT DOCUMENTS

| | | | |
|---|---|---|---|
| 659,468 | 10/1900 | Cooper . | |
| 1,071,449 | 8/1913 | McAfee . | |
| 1,469,631 | 10/1923 | Ehrlich . | |
| 2,008,407 | 7/1935 | Stoever | 62/325 X |
| 2,195,604 | 4/1940 | Taylor | 62/115 |
| 2,342,468 | 2/1944 | Hallwood | 198/181 |
| 2,545,749 | 3/1951 | Pusch | 62/89 |
| 3,233,422 | 2/1966 | Kobrin | 62/441 X |
| 3,455,119 | 7/1969 | Bright | 62/180 |
| 3,792,595 | 2/1974 | Willis | 62/407 X |
| 4,063,432 | 12/1977 | Chaussy | 62/441 X |
| 4,280,335 | 7/1981 | Perez et al. | 62/441 X |
| 4,505,126 | 3/1985 | Jones et al. | 62/239 |
| 4,562,883 | 1/1986 | Janeke | 62/97 |
| 4,599,871 | 7/1986 | Fredrixon | 62/441 X |
| 4,744,225 | 5/1988 | Shoji et al. | 62/407 X |
| 4,765,147 | 8/1988 | Adachi | 62/407 X |

OTHER PUBLICATIONS

Standard Handbook for Mechanical Engineers, Eighth Edition, McGraw-Hill Book Company, New York, pp. 18-19, "Mechanical Refriferation", Nov. 1989.

*Primary Examiner*—Lloyd L. King

*Attorney, Agent, or Firm*—Quirk, Tratos & Roethel

[57] ABSTRACT

A warehouse having a cluster of inner cells for receiving and storing processed frozen food products at extremely low temperatures. The inner cells are surrounded by outer cells for receiving and storing processed refrigerated food products at a more moderate temperature. The outer cells function to insulate the inner cell from cooling temperature losses resulting from higher temperatures externally of the outer cell. The inner and outer cells being cooled by heat transfer of rising warm air from the cells to cooled air being driven by combination evaporator and fan units through closed loop finned duct systems located beneath the cell ceilings.

20 Claims, 5 Drawing Sheets

COLD STORAGE WAREHOUSE

This invention relates to a warehouse for receiving and storing processed refrigerated and frozen food products waiting to be shipped to the marketplace and more particularly to an improved refrigeration system and method of refrigeration for such a warehouse.

BACKGROUND OF THE INVENTION

The modern homemaker relies heavily on the availability of foodstuffs that can be purchased in a refrigerated or frozen state. Between the time the food is processed and the time it reaches the marketplace, the processed food may be held in a distributor's warehouse under strictly controlled temperatures. The cost of operating the cooling and refrigeration equipment of necessity must be added to the selling cost of the processed products.

As described in Mark's Standard Handbook for Mechanical Engineers, Eighth Edition, McGraw-Hill Book Company: "The modern system of cooling which has been installed in the highest type of warehouse consists of a coil room containing the necessary brine coils, through which the air from the different rooms is circulated by a pressure blower. The inlet and outlet of each room are so arranged that the cooled circulating air will cover the entire room in transit; this is usually accomplished by having the cold air inlet in the center of the room and two return outlets-one at each end of the room."

The foregoing system basically was disclosed in U.S. Pat. No. 659,468 issued to M. Cooper. In the Cooper system cool air is forced into the cold storage rooms through ducts arranged on the lower parts of the walls of the rooms. The warm air was removed from the tops of the rooms through perforated ceilings and returned to the cooling rooms.

It is an object of the present invention to provide a cold storage warehouse that operates without the massive refrigeration equipment required to operate a brine cooling system.

More particularly it is yet an object of the present invention to provide a refrigeration system for removing heat from a cold storage room through a heat transfer process with cooled air being circulated in a closed loop, finned, duct system wholly suspended below the ceiling of a storage room thus avoiding blockage of air flow through wall mounted outlets as in the Cooper system.

It is a further object of the present invention to provide a high efficiency multi-cell cold storage warehouse having high degree of flexibility in storing a processed refrigerated or frozen products in any one or more of the cells.

It is yet a further object of the present invention to provide a cold storage warehouse in which freshly processed food products can be placed in a cold storage room and within six to twelve hours be refrigerated to a low enough temperature to be shipped the same day as processed or can be refrigerated to a frozen state within a minimum of twenty-four hours for shipment the day after being processed.

It is yet a further object of the present invention to provide cold storage facilities at a 20 to 40 percent cost saving depending on location in hot or cold climate, to provide a system for lowering temperatures at an energy saving of 40 to 60 percent and to provide a cooled air directional flow compatible with Coriolis forces acting on the moving air stream, that is a clockwise flow in the northern hemisphere and a counterclockwise flow in the southern hemisphere.

It is yet a further object to provide a warehouse in which the areas adapted for frozen food storage are insulated against the effects of temperatures outside the warehouse structure. This is accomplished by surrounding the low temperature storage areas by storage cells not requiring the low temperature required by frozen food storage areas.

And it is yet a further object of the present invention to provide an improved method of rapidly reducing the temperature in a cold storage cell by causing the warm air rising from newly processed food products to rise into contact with cold air being forced through a closed loop duct system having openings therein whereby a heat transfer takes place from the warm air to the cooled air, the heat transfer being permitted to continue until the storage cell temperature reaches equilibrium with the temperature of the cold air flowing through the duct system.

These and other objects of the invention will be apparent from the disclosure of a preferred embodiment thereof.

SUMMARY OF THE INVENTION

The cold storage warehouse of the present invention comprises a structure having a plurality of cells for receiving processed and frozen food products to be maintained at proper storage temperatures. The structure has an inner grouping of cells adapted for storage of food products at below zero temperatures. This group of cells is surrounded by an outer ring of cells adapted for storage of food products at above freezing temperatures. Temperatures in all cells are controlled by a system of finned ducts suspended beneath the ceiling of each of the cells. The finned ducts in each cell are arranged in a closed loop. Each loop contains one or more combination evaporator and fan units, the number depending on the ultimate low temperature to be produced for a particular storage cell. Each duct loop has about one quarter of its surface area open to the interior of the cell in which it is located. Each cell is provided with a plurality of reversible ceiling fans operative to pull heated air up to the ceiling where a heat transfer is effected with the cooled air being circulated by the evaporator and fan units through the finned duct system. The desired temperature is reached when the temperature of air being circulated upwardly by the fans is substantially in equilibrium with the temperature of the air being forced through the duct system in the particular cell. The cooled air is supplied for the duct loop by a split ventilation system in which a combination evaporator and fan unit (or units) is located in the duct and the related compressor is located in an enclosed loft. The condensers are located outside of the warehouse, preferably on the roof.

BRIEF DESCRIPTION OF THE DRAWINGS

This invention is described in greater detail with reference to the drawings, in which.

DETAILED DESCRIPTION OF THE INVENTION

Figure 1:
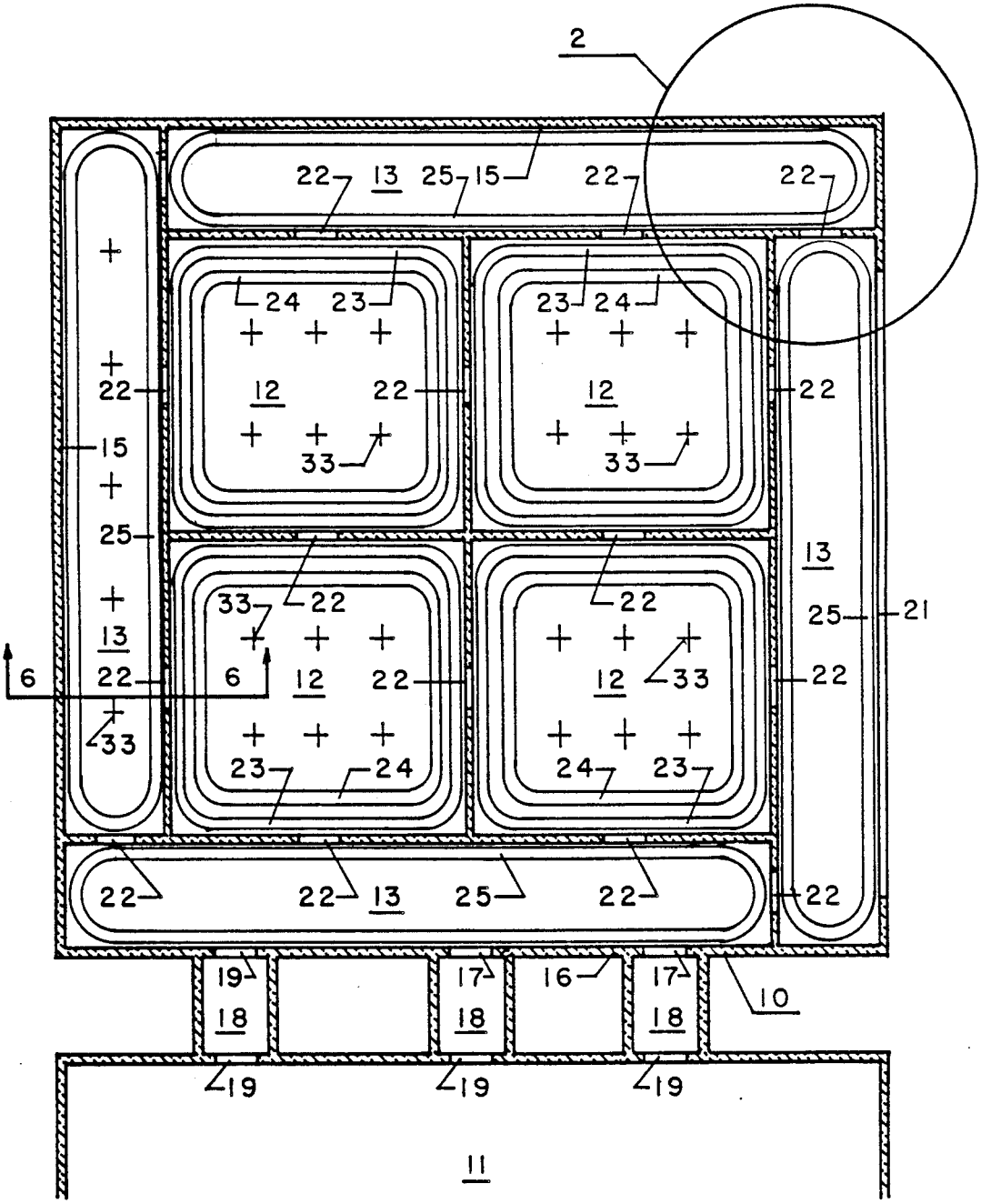
FIG. 1 is a schematic plan view of a the interior of a cold storage warehouse in accordance with the present invention.

Referring first to FIG. 1, there is schematically shown a plan view of a section of a cold storage warehouse, generally designated 10, preferably adjoining a food processing plant 11. The cold storage warehouse 10 is shown as comprising a cluster of four inner storage cells 12. The inner storage cells 12 are shown as square although it will be understood they are not limited to that configuration. The cluster of inner cells 12 are surrounded by four elongated rectangular outer cells 13 that are interposed between the inner walls 14 of the inner storage cells and various outer walls and openings in the warehouse. As shown, the warehouse has two uninterrupted side walls 15 forming a corner of the warehouse and a third sidewall 16 having a plurality of openings 17 leading to passageways 18 providing entries 19 to the processing plant 1. The fourth side 21 of the warehouse outer walls is schematically shown as an opening to a loading dock (not shown). Each of the storage cells 12 and 13 are provided with entryway 22 opening through the various walls separating the inner cells 13 from each other and the adjacent outer cells from each other.

Preferably all of the walls and the doors of the warehouse are thermally insulated with materials capable of practically eliminating heat transfer by radiation and convection.

Each of the cells 12 are provided with a pair of closed loop ducts 23 and 24 that ar suspended in substantially parallel relationship to each other below the ceiling of the cell, see FIG. 2. Each of the cells 13 have a single closed loop duct 25 also suspended below the ceiling of the cell.

Figure 3:
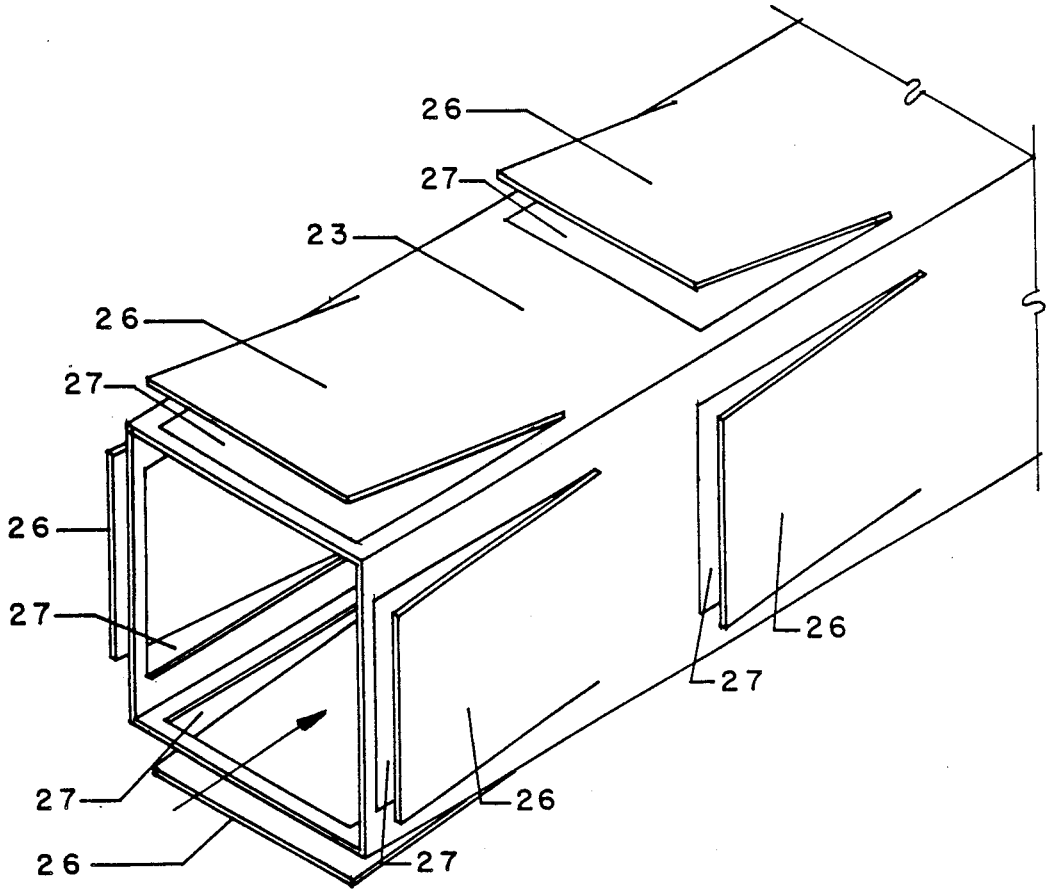
FIG. 3 is an isometric view of a typical section of the duct system embodied in the present invention.

Each of the ducts 23, 24 and 25 are constructed and arranged to function in a high capacity heat transfer system. The ducts 23 and 24 preferably are of square cross section and are formed on all sides with outwardly inclined fins 26, as best seen in FIG. 3. The openings 27 in the ducts resulting from the formed fins approximate 25 percent of the wall area of the ducts. In addition to the fin formed openings 27 each duct is integrated with a plurality of evaporator-fan 28. The evaporator-fan 28 are conventional in that each one houses evaporator coils, a fan for causing air flow through the evaporator coils and discharging the cooled air into a duct and a drip pan beneath the evaporator coils to catch the condensate from the coils in a defrost cycle. Each evaporator 28 is part of a split refrigeration unit. That is, each compressor 29 and condenser 31 are mounted on the warehouse superstructure remotely from the evaporator 28 to which it is operatively connected (see FIG. 6).

Figure 2:
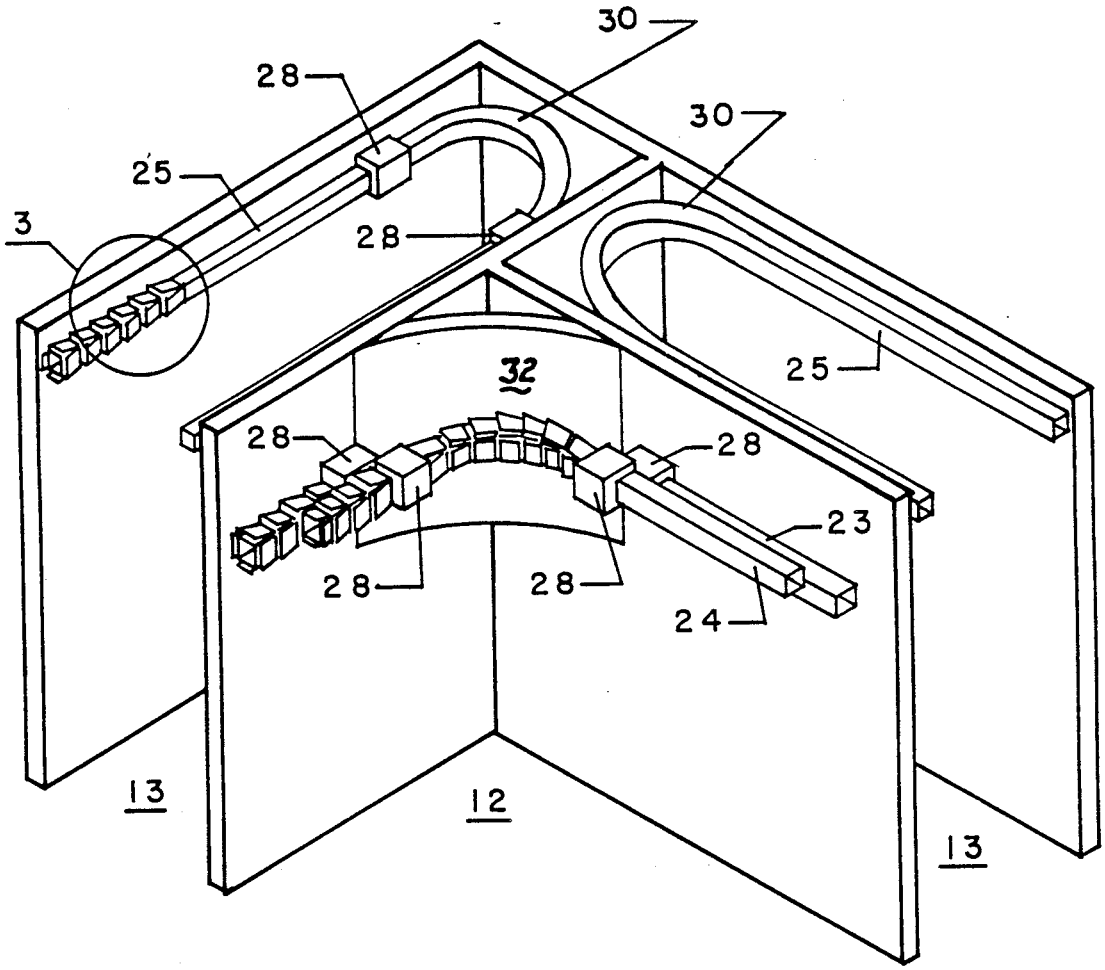
FIG. 2 is an enlarged isometric view of a corner of a cold storage warehouse the view being taken within the circle 2 of FIG. 1.

FIG. 2 represents one corner of a storage cell 12. The structure disclosed is duplicated in each corner of the cell. The closed loop duct 23 has a evaporator 28 at each side of the corner. The duct 24 also has an evaporator at each side of the corner. The ducts 23 and 24 are laterally and vertically offset from one another. Behind the curved corner portion of the ducts 23 and 24 is a curved baffle 32 to cause smoother air flow circulation around the cell as occurs when the heat transfer system is placed in operation.

FIG. 2 is also representative of one corner of each of the cells 13. As best seen in FIG. 2, the single duct 25 is provided with an evaporator 28 at each side of the curved duct portion 30. In this arrangement the curved duct portion 30 is without fins because the curvature would be too sharp to permit smooth air flow around the corner if the duct 25 had openings between the evaporator-fan units 28. The portion of duct 25 and associated evaporator-fan units 28 is duplicated at the opposite end (not shown) of cell 13.

The heat transfer system of the present invention operates as follows:

Processed foods to refrigerated or frozen are brought into the cold cell 12 from the food processing plant 11. With the refrigerant units in operation, cold low pressure refrigerant passes to the evaporator cooling coils. Heat from the air flowing through the ducts causes the cold, low pressure refrigerant in the evaporator coils to vaporize. The vaporized refrigerant carries the heat transferred from the air flowing through the ducts to where the refrigerant is compressed. From the compressor the now hot vapor enters the condenser where it is liquified and then recycled to the evaporator after passing through an expansion valve which reduces its pressure and temperature.

The fan in each evaporator-fan unit circulates the air flowing in the duct over the evaporator coils. Since the evaporators are serially mounted in each closed loop duct system, there is an increase in air flow velocity in the duct system and a decrease in air temperature. The direction of air flow through the duct system is indicated by the arrow in FIG. 3. No air is lost through the fin openings 27. Instead, a negative pressure area is created around the duct openings. In addition, as the cooled air velocity increases the friction of the cooled air molecules increases creating a magnetic field effect within the ducts and adjacent o to the duct openings. The magnetic field effect attracts the molecules of warm air rising from the processed foods within the cell 12. The molecules of the warm are drawn into contact with the rapidly flowing cooled air molecules in the ducts 23 and 24 and a heat exchange takes place in accordance with the basic thermodynamics principle that heat flows in the direction of cold. The heat transfer will continue until thermal equilibrium between the cell and the cooled air flowing through the closed loop ducts is reached.

Figure 6:
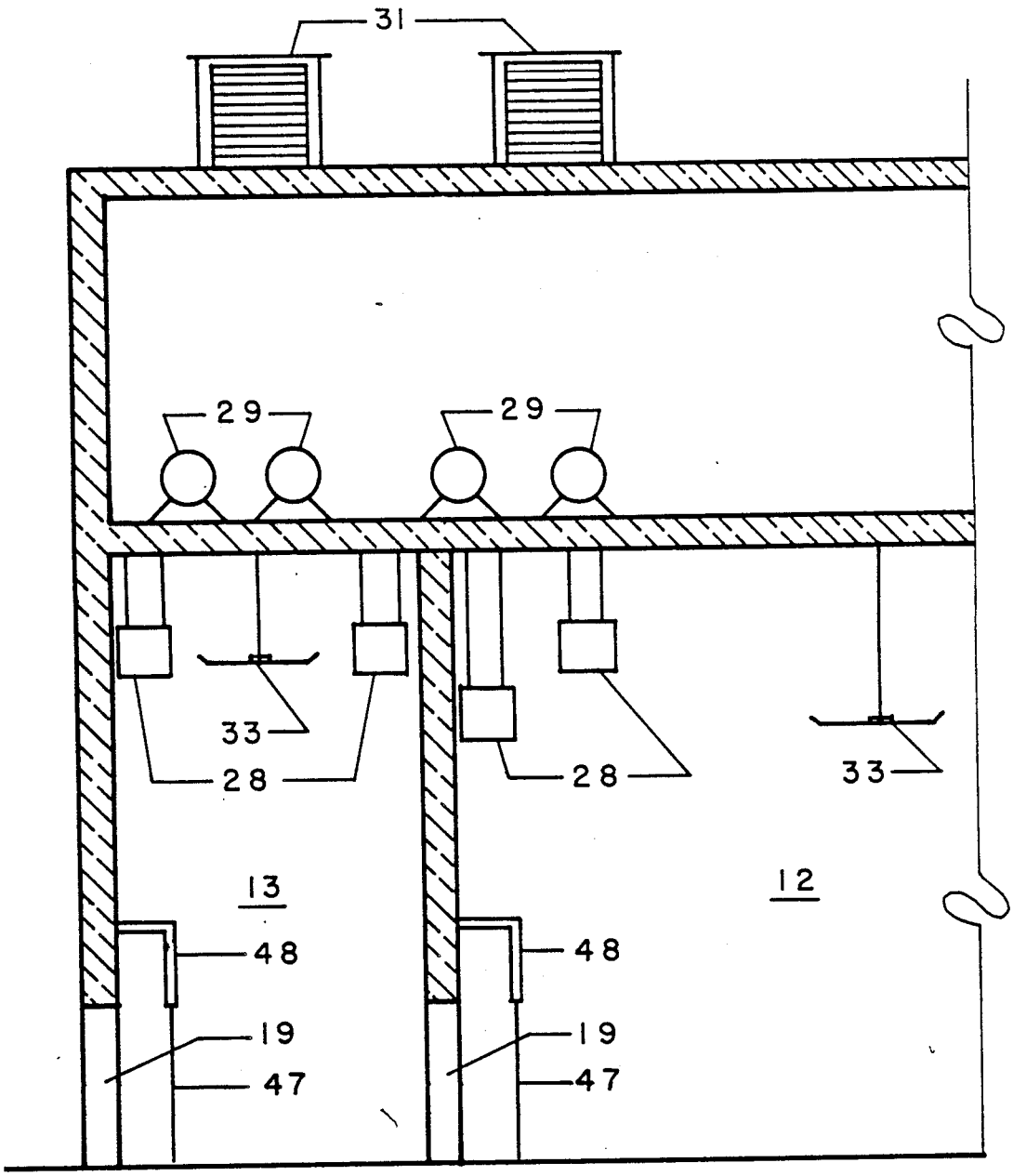

As indicated in FIG. 1 and 6, the cells have ceiling mounted reversible, two speed fans 33 that can be rotated in a direction to accelerate the rise of the warm air. The fans are reversible so that certain of the fans can be reversed as necessary to control the air circulation in the cells. For example, preferably the fans in the center of the cells are periodically reversed to provide a downdraft forcing air from the base of the processed food stockpiles toward the side walls of the cells where the air flow then will be drawn upwardly toward the ducts.

With the heat transfer system embodying the present invention a cell 12 temperature of minus 15° to minus 25° Fahrenheit is attainable and food products can be frozen solid in approximately twenty-four hours ready for shipment. Processed refrigerated products can be readied for shipment six to twelve hours after being placed in a cooler cell 12.

The cells 13 with only the single duct system and a lessor number of evaporator-fan units 28 circulating cooled air through the ducts can readily attain and maintain a temperature of 30° to 35° Fahrenheit. This provides an advantage in that the outer cells 13 are able to insulate the much colder inner cells 12 against heat gain through the warehouse walls when the warehouse is located in a warm climate.

With reference to FIG. 3 and the arrow indicating the direction of air flow in the duct, its should be noted that the air flow through the ducts should be in a clockwise direction in the northern hemisphere and in a counterclockwise direction in the southern hemisphere so as to be compatible with the coriolis force acting on a moving air stream.

Figure 4:
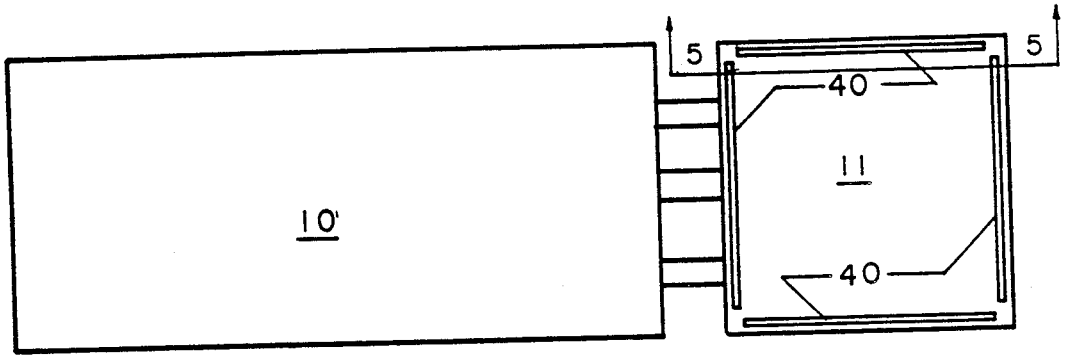
FIG. 4 is a schematic layout of a cold storage warehouse in relation to a food processing plant, the latter utilizing a duct system in accordance with that shown in FIG. 3.
Figure 5:
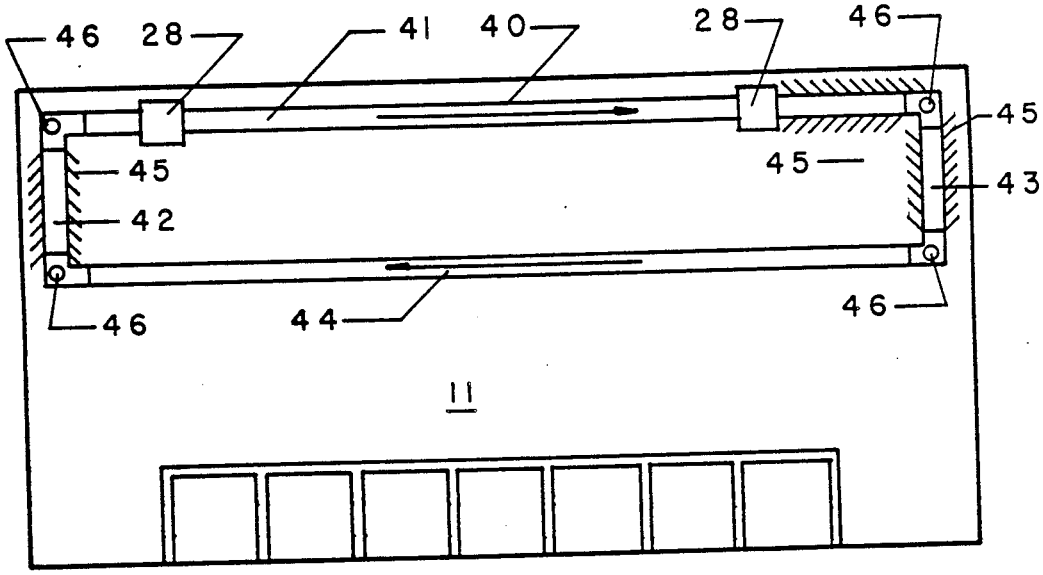
FIG. 5 is a partial side elevation of the processing plant taken on the line 5—5 of FIG. 4.

Referring now to FIGS. 4 and 5, there is shown a modified heat transfer system for the processing plant are 11. This area is occupied by employees preparing food products for transfer into the cold storage warehouse 10. The processing plant area has to be maintained at a reasonably cold but draft free temperature. Preferably, the duct system comprises closed loop ducts 40 mounted on the walls of the processing plants below the ceiling. Each duct 40 has a horizontally extending upper system 41 immediately below the ceiling, two vertical sections 42–43 at each end of the upper section 41, and a lower horizontal section 44 paralleling the upper section. The upper section 41 and the vertical sections are formed with fins 45 similar to those used on the ducts in the cells 12 and 13. The lower section 44 which is located approximately twelve feet above the working area has no fins and no openings since it is desired to maintain the lower working level draft free.

The upper horizontal section 41 is provided with two serially operable evaporator-fan units 28 for circulating cooled air through the closed ducts loop 40. Warm air rising from the work area loses its heat to the cooled air flowing through each duct system 40 as explained with the heat transfer system used in cells 12 and 13. Auxiliary fans 46 at the lower corner of each duct system 40 assist in the flow of air through the ducts.

As shown in FIG. 6, provision is made for minimizing cooled air flow through the entries 19. Plastic air curtains 47 are hung from overhanging canopies 48 positioned to temporarily trap any hot air flowing through the door while the latter is opened.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only the following claims.

What is claimed is:

1. A cold storage warehouse comprising:

(a) a plurality of cells for receiving processed refrigerated and frozen food products to be maintained at predetermined storage temperatures;

(b) duct means having spaced openings therein, the duct means being suspended beneath the ceiling of each cell;

(c) an evaporator and fan unit for circulating cooled air through the duct means to create a negative pressure at the openings so that warm air rising from a cell interior will be drawn into the duct means to cause a heat transfer from the warm air to the cooled air flowing through the duct means;

the heat transfer continuing until the cell temperature reaches equilibrium with the temperature of the air flowing from the evaporator and fan unit.

2. A cold storage warehouse according to claim 1, in which:

the spaced openings in the duct means are defined by fins formed on the duct means.

3. A cold storage warehouse according to claim 1, in which:

the duct means in each cell is a closed loop through which the cooled air from the evaporator and fan unit is recirculated.

4. A cold storage warehouse according to claim 1 in which:

reversible ceiling fans are provided in each cell; the ceiling fans being rotatable in a direction to create an updraft in a cell to accelerate the flow of warm air toward the duct means, or to create a downdraft to move air over the stored products to increase circulation in the cell.

5. A cold storage warehouse according to claim 1, in which:

a plurality of evaporator and fan units are serially spaced along the duct means in each cell to enhance the flow rate of cooled air through the duct means.

6. A cold storage warehouse according to claim 1, in which:

the duct means in selected cells comprises at least two independent ducts forming parallel closed loops within the upper confines of the cells, each independent duct having at least one evaporator and fan unit integral therewith.

7. A cold storage warehouse according to claim 1, in which:

the plurality of cells includes a cluster of cells surrounded by a ring of cells;

the cluster of cells each being adapted to be cooled to a subzero temperature and the surrounding ring of cells adapted to be cooled to freezing temperature to insulate the cluster of cells from heat loss to the outside of the warehouse.

8. A cold storage warehouse according to claim 1, in which:

the plurality of cells includes a cluster of cells surrounded by a ring of cells, each of the clustered cells having duct means comprising two independent finned ducts forming parallel closed loops within the upper confines of the cell, each of the closed loops having a plurality of spaced evaporator and fan units integrated therewith to circulate the cooled air through the closed loop at a high flow rate.

9. A cold storage warehouse according to claim 1, in which:

the plurality of cells includes a cluster of cells surrounded by a ring of cells, each of the ring of cells having duct means comprising a single finned duct having a plurality of spaced evaporator and fan units integrated therewith to circulate cooled air through the duct.

10. A cold storage warehouse according to claim 1, in which:

the plurality of cells includes a cluster of cells surrounded by a ring of cells, each of the clustered cells have duct means comprising two independent finned ducts forming parallel closed loops within the upper confines of the clustered cell, each of the ring cells have a duct means comprising a single finned duct formed in a closed loop within the upper confines of the ring cell, all of the ducts have spaced evaporator and fan units in the closed loops for increasing the velocity of the cooled air flowing therethrough, the increasing velocity of the cooled air increasing its molecular friction and creating a magnetic effect field attracting the molecules of warm air rising from the food products within the cell and causing a heat transfer to occur between the cooled air molecules and warm air molecules, the heat transfer continuing until the storage cell temperatures reach equilibrium with the cooled air flowing through the duct system.

11. A cold storage warehouse comprising:

(a) a plurality of food storage cells adjacent to a food processing plant;

(b) duct means in the storage cells and the food processing plant, the duct means in each of the cells and the food processing plant being independent units mounted in the cells and processing plant adjacent the ceilings thereof, all of the duct means being encircled by fin formed openings except the duct means in the processing plant in which the fin formed openings are omitted from the bottom side thereof; and (c) evaporator and fan units for circulating cooled air through the duct means to create a negative pressure at the openings so that warm air rising from the interior of a cell and the processing plant will be drain into the duct means to cause a heat transfer to the cooled air flowing through the duct means.

12. A cold storage warehouse according to claim 11, in which:

reversible ceiling fans are provided in each cell, the ceiling fans being rotatable in a direction to create an updraft in a cell to accelerate the flow of warm air toward the cell duct means, or to be selectively operated in a reverse direction to create a downdraft to move air over stored products to increase circulation at lower levels of the cell.

13. A cold storage warehouse according to claim 11, in which:

the plurality of food storage cells includes a cluster of cells surrounded by a ring of cells;

the duct means in each cell in the cluster of cells comprises two independent ducts forming parallel closed loops;

each duct loop having a plurality of evaporators integral therewith.

14. A cold storage warehouse according to claim 11, in which;

the plurality of cells includes a cluster of cells surrounded by a ring of cells, each of the ring of cells having duct means comprising a single duct forming a closed loop within the upper confines of the ring cell, each closed loop duct having a plurality of spaced evaporator and fan units integrated therewith to circulate cooled air flowage at a high rate.

15. A cold storage warehouse according to claim 11, in which:

the plurality of food storage cells includes a cluster of cells surrounded by a ring of cells, the duct means in each cell of the cluster of cells comprises two independent ducts forming parallel close loops, the duct means in each of the ring of cells comprise a single duct forming a closed loop within the confines of the ring, and each of the duct loops has plurality of evaporator and fan units integral therewith to circulate cooled air through the ducts.

16. A cold storage warehouse according to claim 11, in which:

the plurality of food storage cells includes a cluster of cells surrounded by a ring of cells insulating the cluster of cells from temperature conditions outside of the warehouse, the duct means in each of the clustered cells comprises two independent ducts forming parallel closed loops and the duct means in each of the ring of cells comprises a single duct forming a single closed loop, each of the duct loops has a plurality of evaporator and fan units therewith to circulate cooled air through the ducts, the temperature of the cells with the two parallel duct loops being reducible to minus 13 to minus 35 degrees Fahrenheit and the cells with the single duct loop being reducible to 30 degrees to 35 degrees Fahrenheit.

17. A cold storage warehouse according to claim 11, in which:

the evaporators are components of a split-refrigeration system in which the compressors are located in an enclosed loft, the condensers are located exteriorly of the warehouse and the fan and evaporator units are mounted in the duct means.

18. A method of maintaining a cold storage cell in a cold storage warehouse at a predetermined temperature, comprising:

(a) providing adjacent to the ceiling of the storage cell a closed loop duct system having openings therein formed in the shape of fins, (b) forcing cooled air into the duct system from refrigeration combined evaporator and fan units integrally mounted in the duct system, (c) recirculating the cooled air past the fin formed openings to create a negative pressure area around the duct system, (d) permitting the warm air in the storage cell to rise into contact with the duct system from lower levels of the storage cell, whereby the warm air is drawn into the duct system and into contact with the cooled air to cause a heat transfer to occur from the warm air to the cooled air, and (e) permitting the heat transfer to continue until the storage cell temperature reaches equilibrium with the temperature of the cooled air flowing through the duct system.

19. The method of claim 18 further comprising operating selected ceiling fans provided in the storage cell in an updraft mode to accelerate the rising of the warm air toward the duct system and other selected fans in a downdraft mode to increase air circulation at the lower level of the cell.

20. The method of claim 18 further comprising utilizing a duct system having parallel closed loops adjacent one another to increase the volume of cooled air flowing through the duct system.

* * * * *